United States Patent [19]

Ogawa

[11] 4,051,624

[45] Oct. 4, 1977

[54] CONTROL TOWER AND TRACK TOY ASSEMBLY

[75] Inventor: Iwakichi Ogawa, Kashiwa, Japan

[73] Assignee: Takara Co., Ltd., Tokyo, Japan

[21] Appl. No.: 694,139

[22] Filed: June 9, 1976

[51] Int. Cl.[2] ..... A63H 19/24

[52] U.S. Cl. ..... 46/202; 46/251

[58] Field of Search ..... 46/201, 202, 251, 260

[56] References Cited

U.S. PATENT DOCUMENTS

| | | | |
|---|---|---|---|
| 3,337,985 | 8/1967 | Ryan et al. | 46/260 |
| 3,589,063 | 6/1971 | Genin | 46/202 |

*Primary Examiner*—John F. Pitrelli
*Assistant Examiner*—Robert F. Cutting
*Attorney, Agent, or Firm*—Jackson & Jones Law Corporation

[57] ABSTRACT

A control tower and track set includes individual track segments and a three-part control tower. The control tower base incorporates a power transmission assembly that is capable of deriving power from a vehicle when it is restrained on the base member. An endless conveyor belt can be driven by the power transmission assembly in either a verticle or horizontal mode of operation. A rotatable control or observation tower is mounted at the top of the control tower and includes a spring-loaded transparent canopy shell that can be activated by the conveyor belt assembly. The individual subcomponents of the control tower can be combined with accessories to form independent toys.

27 Claims, 9 Drawing Figures

FIG. 4
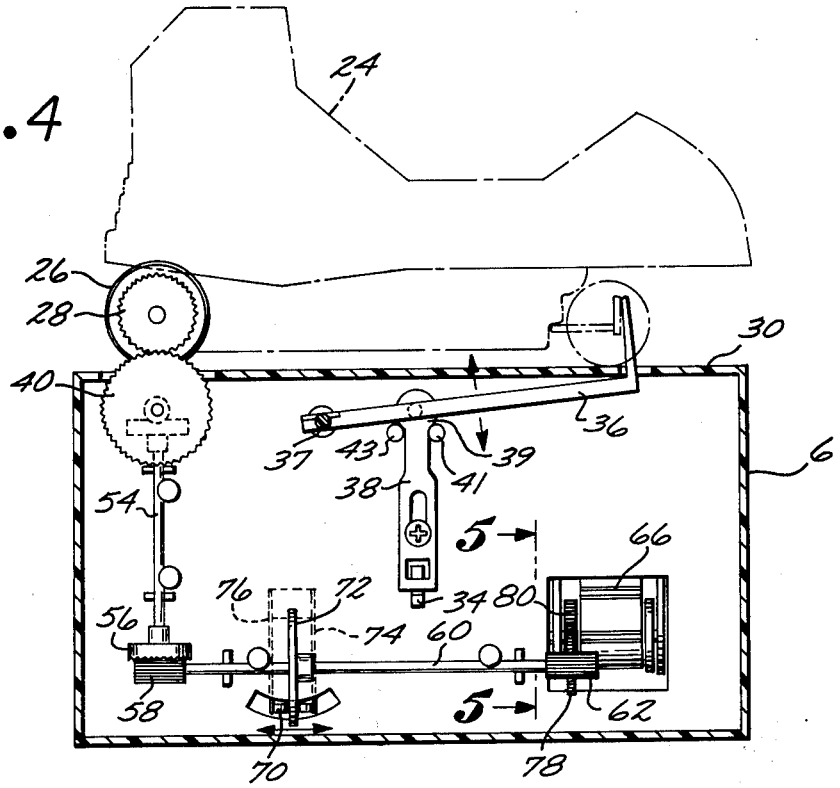
FIG. 5
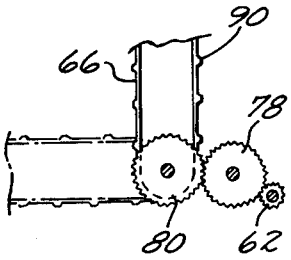
FIG. 7
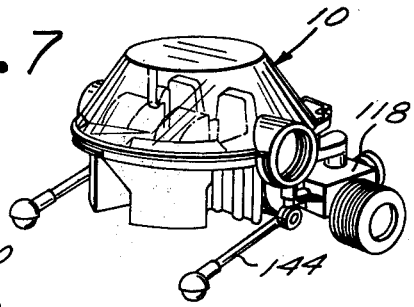
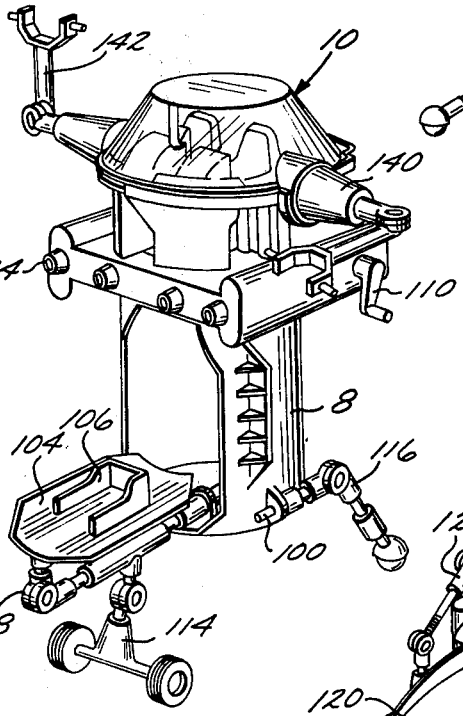
FIG. 6
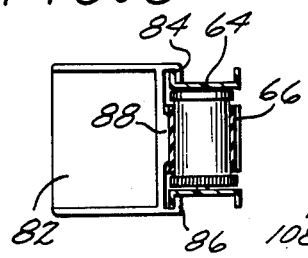
FIG. 9
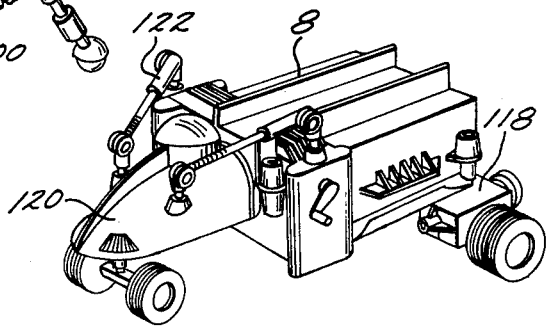
FIG. 8

CONTROL TOWER AND TRACK TOY ASSEMBLY

BACKGROUND OF THE INVENTION

1. Field of the Invention

The present invention is directed to the field of children's toys and more particularly to a control tower and track toy assembly that is capable of forming subcomponent toys.

2. Description of the Prior Art

The prior art has provided a number of vehicle close circuit track sets for children. One example is the commercially available controlled racing systems with accessory buildings. Another example of the prior art, which discloses a toy vehicle passing through a propulsion station, is disclosed in U.S. Pat. No. 3,636,651. The prior art has also provided remotely driven accessories powered by flexible drive cables as shown in U.S. Pat. No. 3,529,378.

Generally the prior art has only provided a limited number of play options for the child with the above toy sets.

SUMMARY OF THE INVENTION

The present invention is directed to a combination toy assembly set which includes a control tower and a closed track system for directing the locomotion of the vehicle.

The control tower includes a base member that incorporates a unique transmission assembly for coacting with the self-energized vehicle to derive power for accessory use. For example, an endless belt assembly can be mounted on the base member and extend upward to an observation module on the control tower. The transmission assembly can power the belt assembly for rotation of the belt and any accessory attached items between the base member and the observation module.

The control tower is formed from subcomponent parts that can be combined with accessories to form individual toys.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 4 is a cross-sectional view of the power transmission base member taken along the lines 4—4 of FIG. 3.

FIG. 5 is a partial cross-sectional view of the power drive for the endless belt assembly taken along the lines 5—5 of FIG. 4.

FIG. 6 is a cross-sectional plan view of the endless belt assembly taken along the lines 6—6 of FIG. 1.

FIG. 7 is a perspective view of a modified embodiment of the present invention.

FIG. 8 is a perspective view of a further modified embodiment of the present invention, and FIG. 9 is a perspective view of still another modified embodiment of the present invention.

DESCRIPTION OF THE PREFERRED EMBODIMENT

Figure 1:
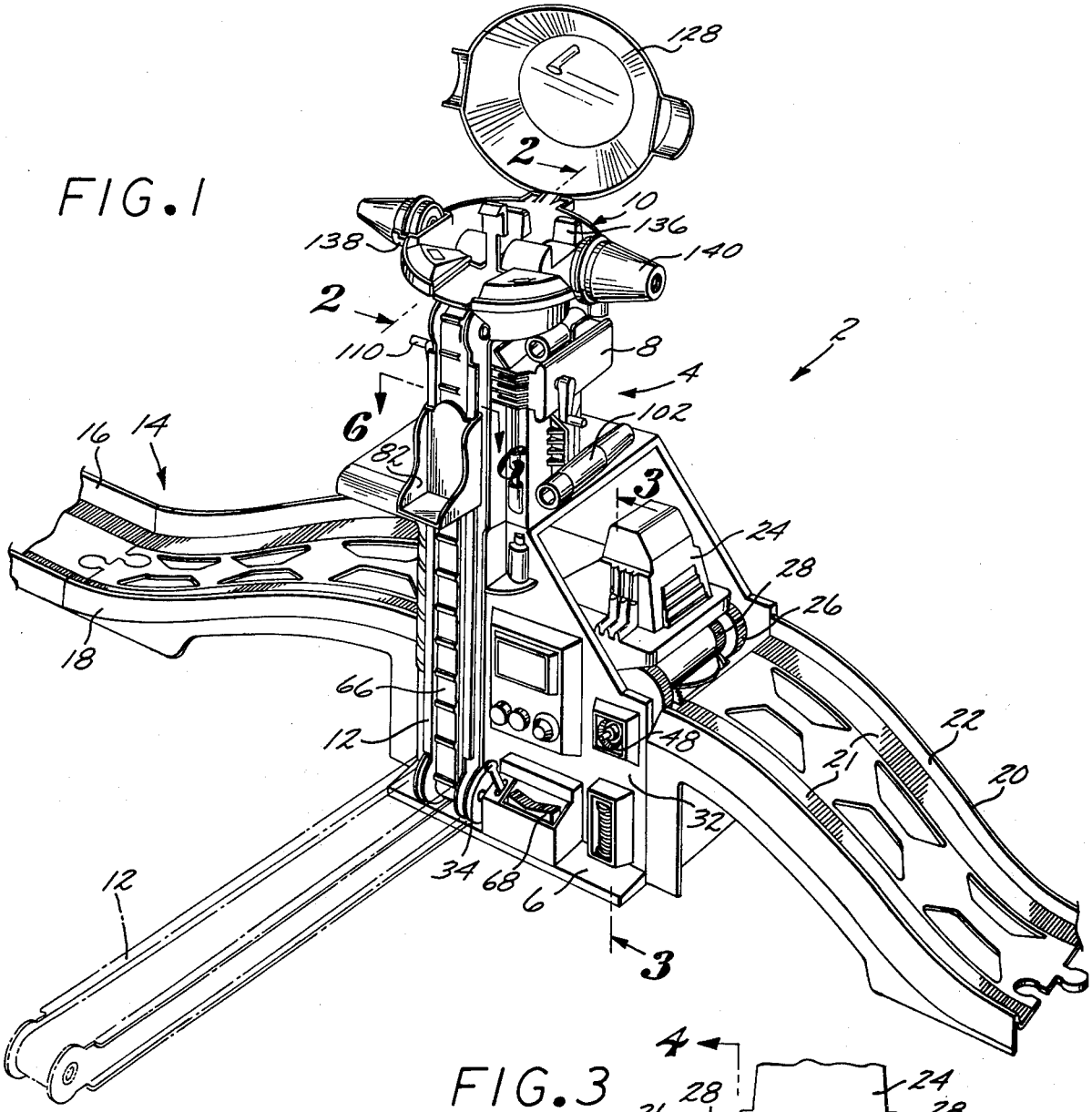
FIG. 1 is a perspective view of the control tower and track set.

The following description is provided to enable any person skilled in the toy industry to make and use the invention and it sets forth the best mode contemplated by the inventor of carrying out this invention. Various modifications, however, will remain readily apparent to those skilled in the above art, since the generic principals of the present invention have been defined herein specifically to provide a relatively economical and easily manufactured control tower and track toy assembly.

The track and control tower assembly 2 of the present invention includes a number of separate component parts that can coact together to form various operative embodiments of the present invention. The control tower assembly 4 includes basically a power transmission base member 6 supporting an intermediate extension member 8 that directly supports a rotatable control or observation module 10. A conveyor belt assembly 12 is pivotally mounted on the power transmission base member 6 and can extend vertically upward on one side of both the extension member 8 and the observation module 10.

A track set 14 can take any appropriate configuration and comprises individual segmented track members 16 which are joined together with a male/female coupling as disclosed. Ramp track members 18 and 20 are designed to interlock with the base of the power transmission base member 6. Each track includes a pair of guide rails 22 and a pair of serrated wheel paths 21.

While not shown, a turnstile track segment can be provided to permit egress and ingress onto the track set 14. This can be accomplished by provided a break in the continuity of the guide rails 22 to permit relatively planar ramp members to have access to the turnstile. The turnstile itself can be a revolvable wheel member mounted on a circular base and having an operator controlled stop member that can be raised or lowered from the surface of the wheel member. When the stop member is raised, it is capable of stopping the forward motion of the vehicle and when it is lowered, it is capable of permitting the vehicle to pass freely across the turnstile wheel member. Freely mounted idler rollers can be positioned on the wheel member at an appropriate distance from the stop member to engage the drive wheels of the vehicle and to permit them to rotate without traction.

Advantageously, the track members 16 as well as the other components of the present invention can be manufactured from plastic although other material can be utilized. Obviously, various subjective surface designs can be molded into or on the track members as desired.

Also included in the assembly 2 is an appropriately proportioned vehicle 24, driven by an electric motor with self-contained batteries. If desired, the vehicle can be given a variable speed, e.g., high/low speed. The vehicle 24 will be retained within the guide rails 22 of the track set 14 and is capable of circumventing the track set under its own power. The vehicle 24 will pass up the appropriate ramp track member and through the power transmission base member 6, if not otherwise restrained.

Figure 3:
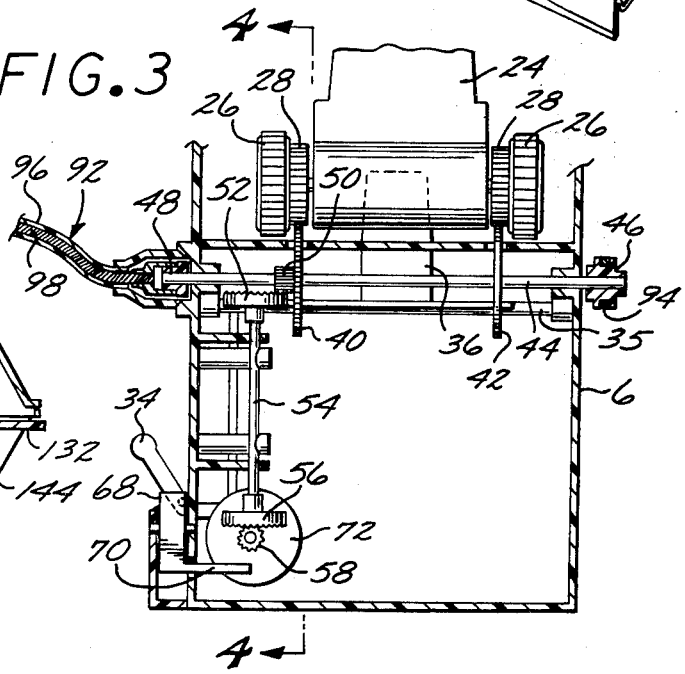
FIG. 3 is a cross-sectional view of the power transmission base member taken along the lines 3—3 of FIG. 1.

Referring to FIGS. 3 and 4, cross-sectional views of the power transmission base member 6 are disclosed with the vehicle 24 being restrained to provide a source of power. The vehicle 24 has, adjacent its rear wheels 26, a pair of drive pinion gears 28 mounted on the drive axle of the vehicle 24. The power transmission base member 6 includes an upper track surface 30 and a side instrument panel wall 32. Appropriate design features can be molded into the wall 32 to simulate various instruments. A lever switch 34 controls a cantilevered stop arm 36 that can extend at one end through the upper surface 30 to restrain the vehicle 24 in an operative position for transmitting power. The stop arm 36 is pivotally fastened to the interior of the power transmission base member 6 in such a manner that an over center bias position exists between the fully retracted and the fully extended positions of the stop arm 36. The lever switch 34 is pivotally mounted to the power transmission base member and is operatively connected to an actuating arm 38 with a camming head 39. A pair of cantilevered followers 41 and 43 extend from the interior surface of the panel wall 32 and are sufficiently resilient to permit the camming head 39 to be forced with a snap action through the restricted passageway between the followers. The stop arm 36 is pivotally connected to the base member 6 by fastener 37. A mounting shaft 35 connects the actuating arm 38 to the stop arm 36. As the actuating arm 38 is moved vertically, it forces the stop arm 36 past a neutral over center position whereupon it will snap to the extreme limit of its travel as the camming head 39 clears the followers 41 and 43.

In the position shown in FIG. 4, the stop arm 36 is extended to restrain the vehicle 24 so that one of its drive pinion gears 28 is meshing with a transfer gear 40. The other pinion gear will ride on an idler disk 42 that is connected to and rotates with the power shaft 44. The power shaft 44 is journaled within the walls of the base member 6 and extends outward to provide respective power couplings 46 and 48, to be described subsequently. Adjacent the transfer gear 40, is a pinion gear 50 mounted on the power shaft 44. The pinion gear 50 meshes with a crown gear 52 connected in turn to a transfer shaft 54 which mounts a secondary crown gear 56 at the other end. Located within the circumference of the secondary crown gear 56 is an elongated spur gear 58 mounted on a power shaft 60 which terminates in a drive spur gear 62. The crown gear 56 is relatively hollow and when the spur ger gear is in the position shown in FIG. 4, it does not mesh for transferring of power.

Referring to the perspective view of FIG. 1, the conveyor belt assembly 12 includes a support frame 64 that is pivotally mounted on the power transmission base member 6. An endless conveyor belt 66 is rotatively mounted on appropriate rollers mounted on the conveyor support frame 64. Lever button 68 controls the application of power to the endless conveyor belt 66 as described in the following manner. A bifurcated lever 70 extends inward from the lever button 68 through an arcuate opening in the instrument panel wall 32. The lever 70 captures a disk 72 fixedly mounted on the power shaft 60. A pair of leaf springs 74 and 76 bias the lever button 68 to a neutral position as shown in FIG. 4.

When the lever button 68 is pressed it will horizontally translate the disk 72 and correspondingly the power shaft 60 sufficiently to engage the spur gear 58 with one side of the secondary crown gear 56. Depending upon the direction that the lever button 68 is pressed, the spur gear 58 will be turned in a clockwise or counterclockwise direction which will be transmitted by the power shaft 60 to the drive spur gear 62. The drive spur gear 62 meshes with an intermediate gear 78 which in turn, meshes and drives directly the power gear 80 mounted on the conveyor support frames 64 for appropriately driving the endless conveyor belt 66.

A chair 82 can be mounted on the conveyor belt assembly 12 and is appropriately proportioned to receive a doll figure. The chain 82 includes, on its back, a pair of mounting rails 84 and 86 plus a support shoulder 88 for engaging the ribs 90 on the endless conveyor belt 66. The relative dimensional tolerances of the guide rails 84 and 86 and the resiliency of the ribs 90 permit the chair to be easily mounted on the conveyor support frame 64 and slide along its length.

As can be readily appreciated, the child can control, with the lever button 68, the movement of the endless conveyor belt 66 and correspondingly, the position of the chair 82.

When the vehicle 24 is operatively restrained, it can also drive an outside pulley wheel or power coupling 46 on the other side of the panel wall 32. An idler pulley (not shown) can also be mounted to provide mounting for the driving of a belt 94. On the instrument panel side of the power shaft 44, a coupling 48 is designed to receive a flexible power cable assembly 92. The power cable assembly 92 includes a stationary outer sheath 96 and a drive cable 98. The power cable assembly 92 is capable of providing an auxiliary power source for accessory toys or even to provide rotary power for rotating the observation module 10, as will be subsequently described.

Referring specifically to FIGS. 1, 8 and 9, the extension member 8 is shown in various embodiments of the present invention. In FIG. 1, the extension member 8 forms part of the control tower assembly 4 and is fastened to the top of the power transmission base member 6 through a pair of male couplings 100 that cooperate with female couplings 102 on the base member 6.

The central tubular portion of the extension member 8 is hollow and can be closed by a transparent pivotally mounted door assembly 104. An operator doll figure can be stored in the extension member 8. Mounted on the door assembly 104 is an operator seat 106. The door is removably mounted on the extension member 8 and, as can be seen in FIG. 8, additional accessory items can be interconnected. Basically, in the embodiment of FIG. 1, the door assembly 104 would be directly mounted on a female coupling within member 8 by an intermediate coupling member 108.

The upper rectangular section of the intermediate extension member 8 includes an interior horizontally extending power shaft that mounts removable crank arms 110. The power shaft is connected through a reduction gearing assembly (not shown) to a female coupling on the top of extension member 8. The female coupling can operatively mount, through a friction fitting, a corresponding male coupling mounted on the bottom of the observation module 10. By rotation of the crank arms 110, the observation module 10 can be rotated in either direction. As can be readily appreciated, the crank arm 110 can be removed and the power shaft can be connected directly to the power cable 92 to rotate the observation module 10 from power transmitted through the power transmission base member 6 when the vehicle 24 is being restrained by the stop arm 36.

As can be appreciated from FIGS. 8 and 9, the extension member 8 can be combined to form subassembly toys. In the embodiment of FIG. 8, a front wheel axle assembly 114 is mounted within the female coupling in the extension member 8. Also a pair of leg members 116 having a rotatable ball bearing member are mounted for mobile support.

Referring to FIG. 9, a removable spring powered motor assembly 118 can be connected to the female coupling within the interior of the extension member 8. A front fuselage assembly 120 can be connected to the top of the extension member 8. Accessory extension arms 122 can also be connected to the extension member 8. Thus a child can create sub-vehicles from the toy set 2 which are particularly suitable for operation with an operator doll (not shown).

As can be seen in FIG. 8 mounting sites 124 can be positioned on the extension members 8 and also throughout the track and control tower set 2.

Figure 2:
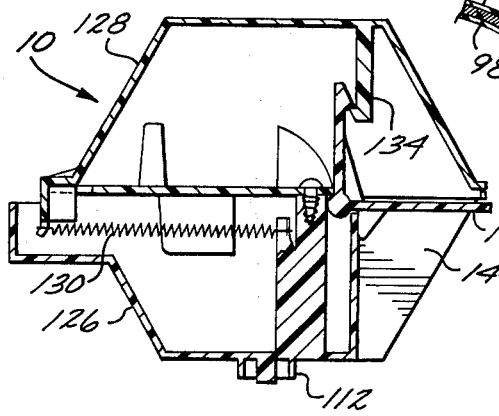
FIG. 2 is a cross-sectional view of the observation module taken along the lines 2—2 of FIG. 1.

Referring to FIGS. 1 and 2, the control or observation module 10 is disclosed and comprises a base member 126 and a pivotable canopy shell 128. A spring 130 is mounted on the base member 126 and biases the canopy shell 128 to the open position shown in FIG. 1. Pivotally mounted on the base member 126 is a trip lever 132 that is capable of engaging a lock-hook member 134 extending downward from the top of the canopy shell 128. Operator control chairs 136 are mounted in the base member 126 and can receive operator dolls.

The observation module 10 also includes mounting couplers 140 in mounting flanges 138 on either side of the base member 126. These mounting couplers 140 are removable and can serve as extension coupling members for attachment of accessories such as grapple arms 142 or even as a coupling member for the observation module 10.

While not shown, the observation module 10 can receive a mounting coupler 140 which is capable of mating with the male coupling member 112 on the base member 126. In one embodiment, the observation module 10 can be mounted on a subcomponent of a robot assembly that is driven by a tractor drive to form a separate vehicle toy.

Referring to FIG. 7, the observation module 10 is mounted on a motor assembly 118 and is supported by a pair of leg members 144. In a manner similar to that of the extension member 8, the observation module 10 can have both male and female mounting sites to receive accessories or to serve as points of connection for a mobile base member. The utilization of these mounting sites are only limited by the accessories purchased by the child and ultimately by the child's own imagination.

As can be seen from the drawings, various decorative ribs, simulated control members and other design characteristics can be subjectively utilized on the component parts of the present invention to enhance the futuristic design aspect for the child. While not shown, additional chairs, signs, rocket launchers and other accessories can be mounted directly on the control tower assembly 4 and on mounting sites provided at the peripheral of the track set 14.

Referring specifically to FIG. 1, the conveyor belt assembly can be operated in either a horizontal or a vertical position. In the vertical position, a support frame 64 frictionally engages with guide rails extending upward on both the power transmission base member 6 and the extension member 8. When the chair 82 is moved to the end of the conveyor belt assembly 12, it will extend into a channel 144 on the observation module 10. As the chain 82 extends into channel 144, the top of the chair 82 will hit a trip lever 132 and cause it to pivot and release the canopy hook 134. The spring 130 will snap the canopy shell 128 into the open position shown in FIG. 1. The tolerances of the relative dimensions of the chair 82 and its interface with the endless conveyor belt 66 will permit the belt 66 to continue to revolve with a frictional slipping past the chair 82.

A child can utilize the track and control tower set 2 in a manner only limited by his imagination. As disclosed in the assembled form of FIG. 1, the child can assembly the complimentary track set 14 and activate the vehicle 24 to circumvent the track set. By use of the lever switch 34, he can raise the stop arm 36 to halt the locomotion of the vehicle 24 and position it to drive the various power shafts in the power transmission base member 6. In this mode of operation, he can activate the conveyor belt assembly 12 through the lever button 68 and can raise or lower the chair 82. An appropriately dimensioned humanoid doll can be mounted in the chair 82 or for that matter other dolls can be mounted on the vehicle 24 or in the observation module 10. With the conveyor belt assembly 12 mounted in a vertical position, the child can use the chair 82 to release the trip lever 132 and open the transparent canopy shell 128. With the conveyor belt assembly 12 in the horizontal position the child can place objects on the conveyor belt and move them away from or toward the control tower assembly 4. Also, in this mode of operation, the observation module 10 is free to rotate either by hand operation with the turning of the crank arms 110 or by automatic operation with the use of a power cable 92 connected to the power coupling 48 and the power shaft of the observation module 10.

The child further has the option of disassembling the control tower assembly 4 into subcomponent parts such as the observation module 10 and the extension member 8. As can be seen in FIGS. 7, 8 and 9 these subcomponent parts can be joined with accessory items to form individual mobile or stationary toy assemblies.

Since numerous permutations are possible within the present invention, the scope of the present invention should be measured solely from the following claims in which I claim:

What is claimed is:

1. A combination toy assembly comprising;
- a base member;
- a control observation module rotatively mounted above the base member including a resiliently biased canopy shell that can be sprung open;
- a toy vehicle capable of operative movement relative to and on the base member;
- power means for energizing the toy vehicle;
- means on the base member for restraining the forward locomotion of the vehicle and,
- transmission means for coacting with the energized vehicle as a source of power to provide an energy output from the vehicle while restrained.

2. The invention of claim 1 further including a track set connected to the base member for directing the vehicle.

3. The invention of claim 2 wherein the track set includes a pair of serrated wheel paths molded into its surface.

4. The invention of claim 1 further including an endless belt assembly connected to the transmission means for rotating a belt.

5. The invention of claim 1 further including a removable extension member connected to the base member, the extension member having a rotatable coupling and means for rotating the coupling.

6. The invention of claim 5 wherein the extension member further includes a removable pivoted door.

7. The invention of claim 5 further including wheel mounting assemblies for mounting on the extension member when removed from the base member to form a separate vehicle.

8. The invention of claim 1 further including a flexible power cable assembly connected to the transmission means.

9. The invention of claim 1 wherein the transmission means includes a first input power connection means for interfacing with the vehicle and a second output power connection means for providing output power including a power shaft movable along its longitudinal axis to vary its rotational direction.

10. The invention of claim 9 wherein the first input power connection means includes a power gear for interfacing with the vehicle and an idler gear to elevate the rear end of the vehicle above in a noncontacting position with the base member.

11. The invention of claim 9 wherein the first input power connection means includes a hollow crown gear and the power shaft includes a pinion gear having a smaller width than the inside diameter of the crown gear so that the pinion gear will not be engaged when positioned within the crown gear to thereby provide a neutral position for the power shaft.

12. The invention of claim 11 further including spring means for biasing the power shaft to the neutral position.

13. The invention of claim 1 wherein the restraining means for the vehicle includes a stop arm moveably mounted in the base member and an over center resilient indexing assembly capable of biasing the stop arm toward a limit of its range of movement.

14. A combination toy assembly comprising;

a base member;

a toy vehicle capable of operative movement relative to and on the base member;

power means for energizing the toy vehicle;

means on the base member for restraining the forward locomotion of the vehicle and, transmission means for coacting with the energized vehicle as a source of power to provide an energy output from the vehicle while restrained including a belt and an endless belt assembly connected to the transmission means for rotating the belt, and, a control observation module having a housing and a resiliently biased canopy shell mounted above the base member, the endless belt assembly extending from the base member to the module and having means for opening the canopy shell.

15. A combination toy assembly comprising;

a base member;

a toy vehicle capable of operative movement relative to and on the base member;

power means for energizing the toy vehicle;

means on the base member for restraining the forward locomotion of the vehicle and, transmission means for coacting with the energized vehicle as a source of power to provide an energy output from the vehicle while restrained including a first input power connection means having a hollow crown gear for interfacing with the vehicle and a second output power connection means for providing output power including a power shaft movable along its longitudinal axis relative to the crown gear to vary its rotational direction, the power shaft further includes a pinion gear having a smaller width than the inside diameter of the crown gear so that the pinion gear will not be engaged when positioned within the crown gear to thereby provide a neutral position for the power shaft.

16. The invention of claim 15 further including a control observation module rotatively mounted above the base member.

17. The invention of claim 16 wherein the observation module further includes a resiliently biased canopy shell that can be sprung open.

18. A combination toy assembly comprising;

a base member;

a control observation module mounted above the base member including a housing and a relatively movable canopy shell;

an endless belt assembly mounted on the base member and extending upward to the control module and further including means for opening the canopy shell, and means for powering the belt assembly to rotate the belt between the base member and the control module.

19. The invention of claim 18 wherein the control observation module is removably and rotatively mounted above the base member and the endless belt assembly is pivotally mounted on the base member.

20. The invention of claim 19 further including accessory wheel assemblies for mounting on the control observation module to form a separate vehicle.

21. A combination toy assembly comprising;

a base member;

a control observation module removably and rotatively mounted above the base member;

an endless belt assembly pivotally mounted on the base member and capable of extending upward to the control module, and means for powering the belt assembly to rotate the belt between the base member and the control module.

22. The invention of claim 21 wherein the control observation module includes a housing and a relatively movable canopy shell, the endless belt assembly further including means for opening the canopy shell.

23. The invention of claim 21 wherein the means for powering the belt assembly includes a self-powered vehicle having a rear axle with a pair of wheels and at least one drive pinion gear mounted on the axle, the base member further including a transmission assembly and means to restrain the vehicle with its rear wheels suspended above the base member and the drive pinion gear meshing with the transmission assembly.

24. A toy assembly capable of providing power to appended accessories comprising;

a base member;

power means for operatively interfacing with the base member to supply a source of power for toy accessories;

transmission means mounted in the base member including a first input power connection means for interfacing with the power means including a hollow crown gear and a second output power connection means for providing output power including a power shaft mounting a pinion gear having a smaller width than the inside diameter of the crown gear so that the pinion gear will not be engaged when positioned within the crown gear to thereby provide a neutral position for the power shaft, the power shaft being movably mounted, on the base member, along the longitudinal axis to vary its rotational direction depending upon which side of the crown gear is engaged with the pinion gear, and means for selectively moving the power shaft.

25. A combination toy assembly comprising;

a track set;

a base member connected to the track set and forming a part thereof;

a removable module mounted above the base member;

an endless belt assembly pivotally mounted to the base member and capable of being operatively mounted in a vertical position along the side of the removable module and in a horizontal position extending away from the base member;

a self-propelled vehicle mounted on the track set for circumventing the track set;

means for selectively restraining the vehicle on the base member;

means for powering the belt assembly from the power of the vehicle and operator controlled means for selectively energizing the endless belt assembly in either a clockwise or counterclockwise rotational direction.

26. The invention of claim 25 further including a control observation module having a housing and a resiliently biased canopy shell mounted above the base member, the endless belt assembly extending from the base member to the module and having means for opening the canopy shell.

27. The invention of claim 26 wherein the means for opening the canopy shell includes a removable chair assembly connected to the endless belt assembly.

* * * * *

UNITED STATES PATENT AND TRADEMARK OFFICE

CERTIFICATE OF CORRECTION

PATENT NO. : 4,051,624

DATED : October 4, 1977

INVENTOR(S) : Iwakichi Ogawa

It is certified that error appears in the above-identified patent and that said Letters Patent are hereby corrected as shown below:

Column 2, line 36 delete "provided" and insert --providing--.

Column 3, line 46 after "spur" delete --ger--.

Column 3, line 46 after "gear" insert --58--.

Column 4, line 8 delete "chain" and insert --chair--.

Column 5, line 68 delete "chain" and insert --chair--.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*